US012207720B1

(12) United States Patent
Cai

(10) Patent No.: US 12,207,720 B1
(45) Date of Patent: Jan. 28, 2025

(54) ARTIFICIAL NAIL

(71) Applicant: Guiwen Cai, Guangzhou (CN)

(72) Inventor: Guiwen Cai, Guangzhou (CN)

( * ) Notice: Subject to any disclaimer, the term of this patent is extended or adjusted under 35 U.S.C. 154(b) by 0 days.

(21) Appl. No.: 18/401,543

(22) Filed: Dec. 31, 2023

(30) Foreign Application Priority Data

Oct. 27, 2023 (CN) ..... 202322904759.X

(51) Int. Cl.
*A45D 31/00* (2006.01)

(52) U.S. Cl.
CPC ..... *A45D 31/00* (2013.01); *A45D 2031/005* (2013.01)

(58) Field of Classification Search
CPC . A45D 31/00; A45D 2031/005; A45D 29/001
See application file for complete search history.

(56) References Cited

U.S. PATENT DOCUMENTS 2,816,555 A * 12/1957 Klump ..... A45D 29/001 132/73
2,864,384 A * 12/1958 Walter ..... A45D 29/001 132/73
3,598,685 A * 8/1971 Lee et al. ..... A45D 29/001 132/73
4,751,935 A * 6/1988 Mast ..... A61Q 3/00 132/73
4,876,121 A * 10/1989 Cohen ..... A45D 31/00 156/289
5,975,087 A * 11/1999 Jang ..... A45D 29/001 132/73
11,439,217 B2 * 9/2022 Drozdowska ..... A61K 8/42
11,793,289 B2 10/2023 Chen
2002/0023656 A1 * 2/2002 Chang ..... A45D 31/00 132/73
2019/0281947 A1 * 9/2019 Kim ..... B32B 27/36
2019/0374003 A1 * 12/2019 Lee ..... A45D 31/00

FOREIGN PATENT DOCUMENTS

CN 215649662 U * 1/2022 ..... A45D 31/00
KR 2019117079 A * 10/2019 ..... A45D 29/001

* cited by examiner

*Primary Examiner* — Tatiana L Nobrega
(74) *Attorney, Agent, or Firm* — Andrew C. Cheng

(57) ABSTRACT

An artificial nail is provided, it comprises a nail flake, a guiding groove is provided on a top surface of the nail flake, the guiding groove has a groove depth of d, the guiding groove has a groove width of b, 0.05 mm≤d≤0.2 mm, and 0.05 mm≤b≤0.2 mm, and the guiding groove is used for guiding a user to draw a pattern or mount a decorative piece on the top surface of the nail flake. A guiding groove is provided on the nail flake, the guiding groove in the form of a groove has a certain depth and width, and the contour is clearly visible, so that it is easy to guide the user to make a design positioning on the nail flake and to complete the design quickly, for example, the user can be guided to draw a pattern or install a decorative piece on the nail flake; in addition, the guiding groove in the form of a groove can be filled in easily by the sealing layer applied to the top surface of the nail flake, which does not leave traces, so that the top surface of the nail flake is smooth and even; in addition, the guiding grooves in the form of grooves are more resistant to abrasion, and will not be easily sanded off, so even after sanding the top surface of the nail flake, the guiding grooves can still be clearly shown on the top surface of the nail flake.

9 Claims, 4 Drawing Sheets

ARTIFICIAL NAIL

TECHNICAL FIELD OF THE INVENTION

The present disclosure relates to the technical field of beautifying nails, in particular to an artificial nail.

BACKGROUND OF THE INVENTION

Artificial nails, also known as false nails, fashion nails, acrylic nails, nail covers or nail extensions, are extensions placed on a person's nails as fashion accessories.

In order to facilitate artistic aesthetics, guide lines for guiding people to draw patterns or install decorative parts are generally provided on the surface of the artificial nails, but, in practice, the guide lines of the line structure are easily polished off in the polishing step of the artificial nails, so that the people cannot be guided to draw patterns or install decorative parts on the artificial nails, and in the absence of polishing, the nail varnish applied to the artificial nails cannot be reliably bonded with the artificial nails, resulting in the easy peeling off of the nail varnish layer and the difficulty in covering the guide lines of the line structure by the sealer, thus affecting the aesthetic appearance.

SUMMARY OF THE INVENTION

Embodiments of the present disclosure provide an artificial nail to solve a problem of the related technology, and the technical solution is as follows:

Embodiments of the present disclosure provide an artificial nail having a guiding groove on a top surface of the artificial nail, the guiding groove having a groove depth of d, the guiding groove having a groove width of b, 0.05 mm≤d≤0.2 mm, and 0.05 mm≤b≤0.2 mm, and the guiding groove being used for guiding a user to draw a pattern or mount a decorative piece on the top surface of the artificial nail.

In one embodiment, the glossiness of the groove wall of the guiding groove is greater than the glossiness of the rest of the top surface of the artificial nail.

In one embodiment, the rest of the top surface of the artificial nail has a matte layer and the groove wall of the guiding groove has a glossy layer.

In one embodiment, the matte layer is a first frosted layer.

In one embodiment, the top surface of the artificial nail has a first frosted layer.

In one embodiment, the groove wall of the guiding groove has a second frosted layer.

In one embodiment, the guiding grooves are in a plurality, at least one of the guiding grooves extends in a length direction of the artificial nail, and other guiding grooves extend in a width direction of the artificial nail and intersect with the guiding groove extending in a length direction of the artificial nail.

In one embodiment, a bottom surface of the artificial nail has a third frosted layer.

In one embodiment, the artificial nail is a structure made of a colored translucent material.

In one embodiment, the artificial nail is provided with a colored translucent coating.

Advantages or beneficial effects of the above technical solutions include at least:

A guiding groove is provided on the artificial nail, the guiding groove in the form of a groove has a certain depth and width, and the contour is clearly visible, so that it is easy to guide the user to make a design positioning on the artificial nail and to complete the design quickly, for example, the user can be guided to draw a pattern or install a decorative piece on the artificial nail; in addition, the guiding groove in the form of a groove can be filled in easily by the sealing layer applied to the top surface of the artificial nail, which does not leave traces, so that the top surface of the artificial nail is smooth and even, and the appearance is more beautiful; in addition, the guiding grooves in the form of grooves are more resistant to abrasion, and will not be easily sanded off, so even after sanding the top surface of the artificial nail, the guiding grooves can still be clearly shown on the top surface of the artificial nail, which is convenient for guiding the user to operate in accordance with the set pattern; in addition, since 0.05 mm≤d≤0.2 mm and 0.05 mm≤b≤0.2 mm, the guiding grooves have a suitable depth and a suitable depth, ensuring that the guiding grooves are clearly rendered on the top surface of the artificial nail, and at the same time, the guiding groove can be easily filled up with less sealing material, which saves material and improves the operating efficiency.

The above summarization is for the purpose of the specification only and is not intended to be limiting in any way. In addition to the schematic aspects, embodiments and features described above, further aspects, embodiments and features of the present disclosure will be readily understood by reference to the accompanying drawings and the following detailed description.

BRIEF DESCRIPTION OF THE DRAWINGS

In the accompanying drawings, unless otherwise specified, the same reference signs in the accompanying drawings indicate the same or similar parts or elements. These accompanying drawings are not necessarily drawn to scale. It should be understood that these accompanying drawings depict only some of the embodiments disclosed in accordance with the present disclosure and should not be viewed as limiting the scope of the present disclosure.

Figure 1:
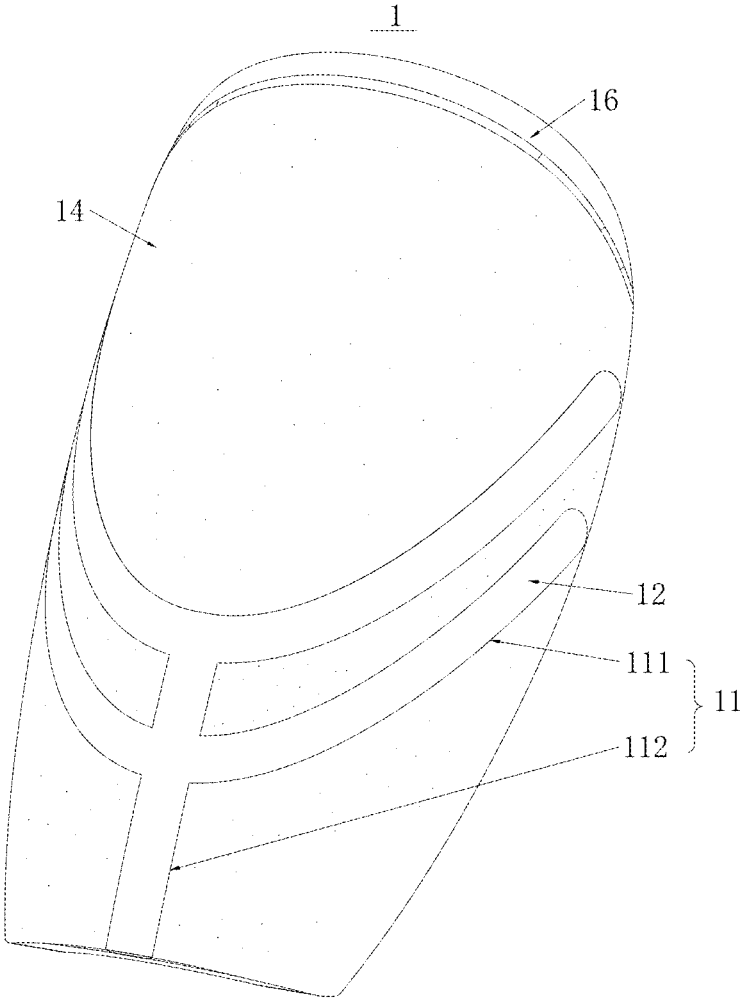
FIG. 1 shows a schematic view of the front structure of an artificial nail of the present disclosure.

Reference signs 1, artificial nail (i.e. fake fingernail), 11, guiding groove, 111, transverse groove, 112, longitudinal groove, 12, glossy layer, 13, second frosted layer, 14, first frosted layer, 15, third frosted layer, 16, colorful translucent coating

DETAILED DESCRIPTION OF THE PREFERRED EMBODIMENT

In the following, only certain exemplary embodiments are briefly described. As can be recognized by those skilled in the art, the described embodiments can be modified in a variety of different ways without departing from the spirit or scope of the present disclosure. Accordingly, the accompanying drawings and description are considered to be essentially exemplary and not limiting.

Referring to FIGS. 1-FIG. 4, there is shown an artificial nail of a preferred embodiment of the present disclosure, the artificial nail 1 comprises a top surface opposite a bottom surface configured to be secured to a natural nail, a proximal edge configured to be secured proximate to a user's natural cuticle, a distal edge opposite the proximal edge and first and second lateral edges disposed between the proximal and distal edges. The top surface includes a guiding groove 11, the guiding groove 11 has a groove depth of d, the guiding groove 11 has a groove width of b, 0.05 mm≤ d≤0.2 mm, and 0.05 mm≤ b≤ 0.2 mm, and the guiding groove 11 is used for guiding a user to draw a pattern (such as a French pattern or a line pattern, etc.) or to mount a decorative piece on the top surface of the artificial nail.

With the artificial nail of the present disclosure, since the guiding groove 11 is provided on the artificial nail 1, the guiding groove 11 in the form of a groove has a certain depth and width, and the outline is clearly visible, so that it is easy to guide the user to position the design on the artificial nail 1 and to complete the design quickly, for example, to guide the user to draw a pattern or install a decorative piece on the artificial nail 1. In addition, the guiding groove 11 in the form of a groove can be filled by the sealing layer applied to the top surface of the artificial nail 1 easily, without leaving traces, so that the top surface of the artificial nail 1 is smooth and even, and the shape is more beautiful; in addition, the groove 11 in the form of a groove is more resistant to abrasion, and will not be easily polished off, so that the groove 11 can be clearly shown on the top surface of the artificial nail 1 even after the top surface of the artificial nail 1 is sanded, thus facilitating the guidance of the user to operate according to a set pattern; furthermore, because 0.05 mm≤d≤0.2 mm and 0.05 mm≤b≤0.2 mm, the guiding groove 11 has a suitable depth and width to ensure that the guiding groove 11 is clearly presented on the top surface of the artificial nail 1, and at the same time, the guiding groove 11 can be easily filled with less sealing material, which saves material and improves the operation efficiency.

In one embodiment, the groove walls of the guiding groove 11 are glossier than the rest of the top surface of the artificial nail 1 so as to highlight the guiding groove 11 and make it easier for the user to observe the direction of the guiding groove 11, thereby making it easier to guide the user to quickly complete the design.

In one embodiment, the rest of the top surface of the artificial nail 1 has a matte layer, and the groove wall of the guiding groove 11 has a glossy layer 12. The top surface of the artificial nail 1 set matte has a certain roughness, which facilitates a reliable combination of the top surface of the artificial nail 1 and the sealing layer, improves the reliability of the connection between the artificial nail 1 and the sealing layer, and makes the sealing layer less likely to come off, whereas the guiding groove 11 set glossy facilitates highlighting the contour of the guiding groove 11, thereby making the contour of the guiding groove 11 more clearly visible and facilitating efficient operation of the user.

Specifically, in one embodiment, the aforesaid matte layer is the first frosted layer 14, i.e., all parts of the top surface of the artificial nail 1 other than the guiding grooves 11 are frosted surfaces that have undergone frosting treatment, so as to improve the roughness of the remaining parts of the top surface of the artificial nail 1, so as to facilitate the reliable bonding of the top surface of the artificial nail 1 with the sealing layer, improve the reliability of the connection between the artificial nail 1 and the sealing layer, and make it difficult for the sealing layer to fall off.

Figure 2:
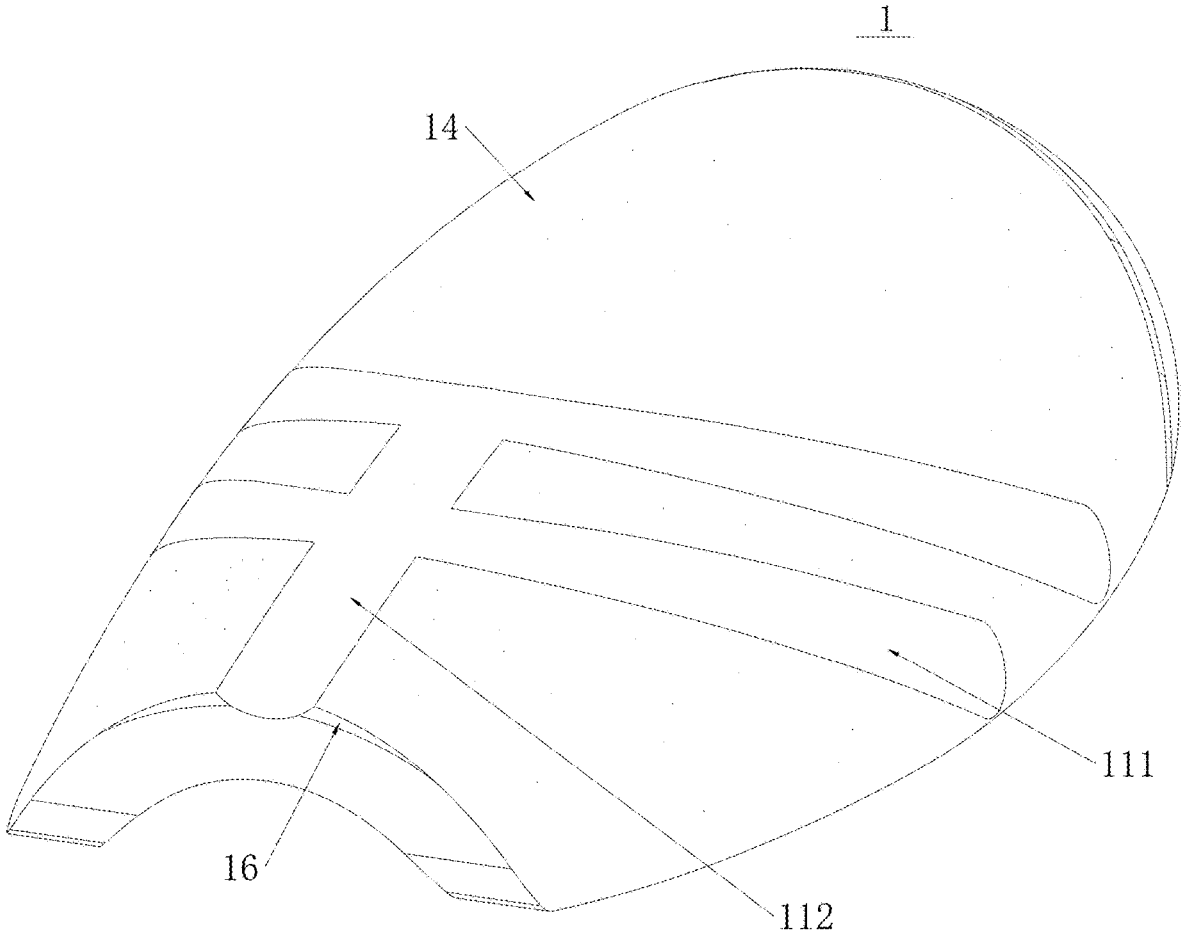
FIG. 2 shows a schematic view of the front structure of the artificial nail of the present disclosure.
Figure 3:
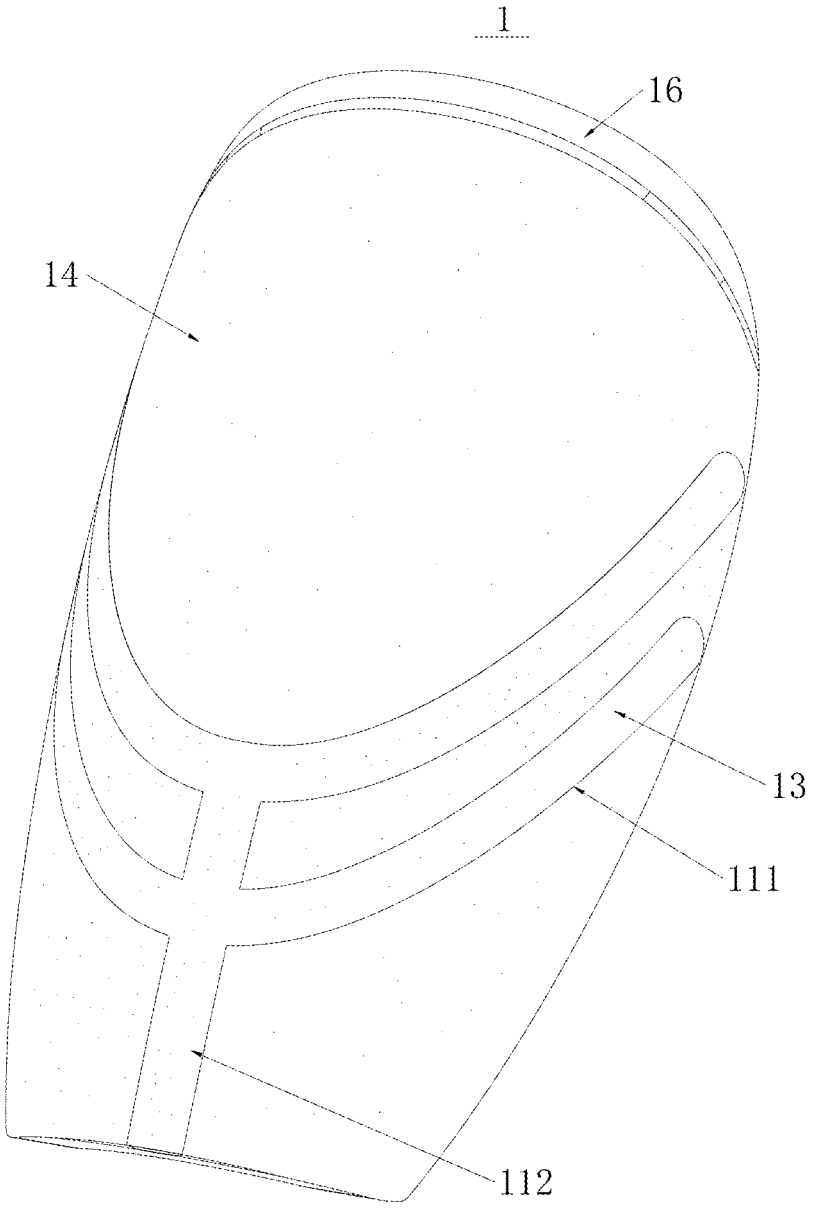
FIG. 3 shows a schematic view of the front structure of the artificial nail of the present disclosure.
Figure 4:
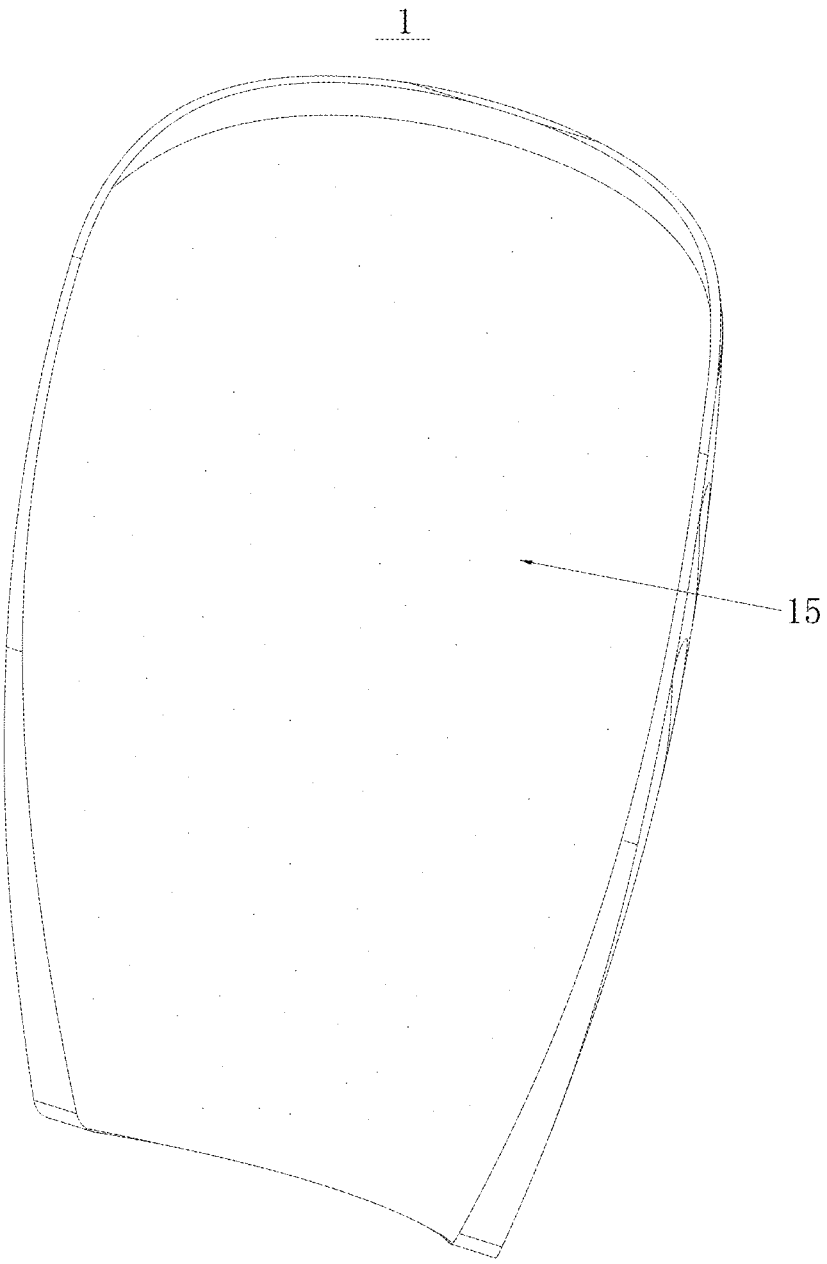
FIG. 4 shows a schematic view of the reverse side structure of the artificial nail of the present disclosure.

Referring to FIG. 2, in one embodiment, the groove wall of the guiding groove 11 has a second frosted layer 13 to improve the roughness of the groove wall of the guiding groove 11, to facilitate reliable bonding of the sealing layer filled in the guiding groove 11 with the artificial nail 1, to improve the connection reliability of the artificial nail 1 and the sealing layer, and to make the sealing layer less likely to fall off.

Referring to FIG. 1, in one embodiment, the number of guiding grooves 11 is plurality, at least one of the guiding grooves 11 extends along the length direction of the artificial nail 1 (i.e., longitudinal groove 112), and the rest of the guiding grooves 11 extend along the width direction of the artificial nail 1 (i.e., transversal grooves 111) and intersect with the other guiding grooves 11 that extend along the length direction of the artificial nail 1, so as to make the top surface of the artificial nail 1 have a pattern with better appearance that improves the aesthetics of the artificial nail. Of course, in other embodiments, the number, shape, and arrangement of the guiding grooves 11 can be adjusted according to actual needs.

In one embodiment, the bottom surface of the artificial nail 1 has a third frosted layer 15 to provide the bottom surface of the artificial nail 1 with a certain degree of roughness, so that the nail glue tightly connects the bottom surface of the artificial nail 1 to the human nail without applying a primer, when the artificial nail being applied to the human nail, which can simplify the operation process and improve the operation efficiency at the same time.

In one embodiment, the artificial nail 1 is a structure made of colored translucent material, which makes the artificial nail 1 have a color and a more beautiful appearance, and at the same time, it is also possible to dispense with the need to coat the artificial nail 1 with colored nail glue oil when applying the nail flake to a human nail, which simplifies the operation process and also improves the operation efficiency.

Specifically, the above mentioned colored translucent artificial nail 1 is injection molded from a uniform mixture of color powder and acrylic material.

In one embodiment, the artificial nail 1 is provided with a colored translucent coating 16, so that the artificial nail 1 has a color and has a more beautiful appearance, and at the same time, it can also eliminate the need to apply colored nail glue oil when applying the artificial nail 1 to a human nail, which can simplify the operation process and at the same time, can also improve the operation efficiency.

In the description of the present specification, the terms "an embodiment", "some embodiments", "example", "specific example", or "some examples", etc. mean that the specific features, structures, materials, or characteristics described in connection with the embodiment or example are included in at least one embodiment or example of the present disclosure. Moreover, the specific features, structures, materials, or characteristics described can be combined in any one or more of the embodiments or examples in a suitable manner. Moreover, without contradicting each other, those skilled in the art can connect and combine different embodiments or examples and features of different embodiments or examples described herein.

Furthermore, the terms "first" and "second" are used only for descriptive purposes and are not to be understood as indicating or implying relative importance or implicitly specifying the number of technical features indicated. Thus, a feature defined with the terms "first", "second" can expressly or impliedly include at least one such feature. In the description of the present disclosure, "more than one" means two or more, unless otherwise expressly and specifically limited.

The above are only specific embodiments of the present disclosure, but the scope of protection of the present disclosure is not limited thereto, and any person skilled in the art can easily think of various variations or substitutions thereof within the scope of the technology disclosed in the present disclosure, all of which shall be covered by the scope of protection of the present disclosure.

Therefore, the scope of protection of this application shall be subject to the scope of protection of the claims.

The invention claimed is:

1. An artificial nail, configured to be placed on a real nail of a user, the artificial nail comprising:

a top surface opposite a bottom surface configured to be secured to a natural nail, a proximal edge configured to be secured proximate to a user's natural cuticle, a distal edge opposite the proximal edge and first and second lateral edges disposed between the proximal and distal edges, a first arcuate groove extending across the top surface, where the first arcuate groove has i) a first terminal end proximate the first lateral edge, ii) a second terminal end proximate the second lateral edge and iii) a first apex disposed centrally between the first and second terminal ends, where the first apex is disposed closer to the distal edge than the first and second terminal ends, a second arcuate groove extending across the top surface, where the second arcuate groove has i) a first terminal end proximate the first lateral edge and proximate the first terminal end of the first arcuate groove, ii) a second terminal end proximate the second lateral edge and proximate the second terminal end of the first arcuate groove and iii) a second apex disposed centrally between the first and second terminal ends, where the second apex is disposed closer to the distal edge than the first and second terminal ends of the second arcuate groove and the second apex is disposed closer to the proximal edge than the first apex, and a linear groove extending from a central portion of the distal edge through the first and second grooves such that the linear groove terminates at the second arcuate groove, wherein the first and second arcuate grooves and the linear groove are recessed inwardly toward the bottom surface, wherein during use, the first and second arcuate grooves and the linear groove are used for guiding a user to draw a pattern with nail polish or to mount a decorative piece.

2. The artificial nail according to claim 1, wherein the first and second arcuate grooves and the linear groove have a glossiness which is greater than a glossiness of a remaining portion of the top surface of the artificial nail which does not include the first and second arcuate grooves and the linear groove.

3. The artificial nail according to claim 1, characterized in that a remaining portion of the top surface of the artificial nail other than the first and second arcuate groove and the linear groove is matte and the first and second arcuate groove and the linear groove are glossy.

4. The artificial nail according to claim 3, characterized in that the matte surface is frosted.

5. The artificial nail according to claim 1, characterized in that the top surface of the artificial nail is frosted.

6. The artificial nail according to claim 1, wherein, the bottom surface is frosted; and the bottom surface is configured to be glued to the real nail of the user.

7. The artificial nail according to claim 1, wherein the entirety of the artificial nail is a one-piece structure made of one colored translucent material.

8. The artificial nail according to claim 1, characterized in that the artificial nail is provided with a colored translucent coating.

9. The artificial nail according to claim 1, wherein, the first and second arcuate grooves and the linear groove each have a depth (d) and a width (b), wherein each of the depths and each of the widths is greater than or equal to 0.05 mm and less than or equal to 0.2 mm.

* * * * *